United States Patent [19]

Ginsburg

[11] Patent Number: 4,467,481

[45] Date of Patent: Aug. 28, 1984

[54] HINGE FOR TOILET SEAT

[75] Inventor: Milton Ginsburg, Bala Cynwyd, Pa.

[73] Assignee: Ginsey Industries, Inc., Bellmawr, N.J.

[21] Appl. No.: 428,296

[22] Filed: Sep. 29, 1982

[51] Int. Cl.[3] ..... A47K 13/12

[52] U.S. Cl. ..... 4/240; 4/236

[58] Field of Search ..... 4/236, 234, 661, 240; 16/128 R, 129

[56] References Cited

U.S. PATENT DOCUMENTS

| | | | |
|---|---|---|---|
| 1,120,410 | 12/1914 | Rohmer et al. | 4/236 X |
| 3,301,121 | 1/1967 | Newcomer | 4/236 X |
| 3,308,483 | 3/1967 | Miller | 4/236 |
| 4,159,548 | 7/1979 | Hauson | 4/236 |
| 4,319,365 | 3/1982 | Bemis et al. | 4/236 |
| 4,326,307 | 4/1982 | Baillie et al. | 4/236 |

*Primary Examiner*—Henry K. Artis

*Attorney, Agent, or Firm*—Paul & Paul

[57] ABSTRACT

A toilet seat hinge, having a threaded bolt for insertion through the bolt hole of the porcelain bowl, is provided with a nut of resilient plastic material having a conical nose the forward diameter of which is smaller than the diameter of the bolt hole of the bowl so that the forward portion of the conical nose may enter the bolt hole until its sloping wall engages the lower edge of the bolt hole.

3 Claims, 2 Drawing Figures

HINGE FOR TOILET SEAT

BACKGROUND OF THE INVENTION

This invention relates to toilet seats and in particular to hinges for toilet seats. A toilet seat is ordinarily equipped with two hinges each having a base portion for attachment to the porcelain bowl, a seat leaf for attachment to the ring seat, and a lid leaf for attachment to the lid. The seat and lid leaves are pivotal in the base portion of the hinge. Each of two bolts, one for each hinge, passes down through a vertical bolt hole in the porcelain bowl and projects therefrom for a sufficient length to receive a nut which is finger tightened, rather than wrench tightened, to avoid cracking the porcelain bowl. In the manner just briefly described, the toilet seat is secured to the porcelain bowl.

While porcelain toilet bowls are manufactured to standard sizes, the specifications and the manufacturing are not sufficiently accurate to assure that the two bolt holes in different porcelain bowls are spaced apart by precisely the same distance. Accordingly, it is customary for the bolt holes in the porcelain bowl to be made substantially larger in diameter than the bolts which are to be passed therethrough. In this manner, allowance is made for differences in the spacing between the bolt holes. Thus, while the installer of a new or different toilet seat onto a bowl will usually find that the bolt holes in the bowl are sufficiently properly spaced to receive the bolts of the new toilet seat, the bolts of the new toilet seat will not always be centered in the bolt holes of the bowl. As a result, when the nuts are fingered tightened on the bolt of the toilet seat, the nut will abut against the under surface of the bowl, but since the bolts have room to move around in the bolt holes of the bowl, there is a tendency for the rear end of the toilet seat to move at least to some extent. This is obviously less satisfactory than a toilet seat that is firmly secured at its rearward end.

SUMMARY OF THE INVENTION

A principal object of the present invention is to provide an improved toilet seat hinge.

A more specific object of the invention is to provide a toilet seat hinge which is adapted to be held firmly in place by finger-tightened nuts.

Another object is to provide a toilet seat hinge which is adapted to secure a toilet seat firmly to the bowl by means of finger-tightened nuts irrespective of whether or not the center-to-center spacing between the bolt holes in the bowl are equal, or not equal, to the center-to-center spacing between the bolts of the toilet seat.

The foregoing objects are achieved by providing for the bolts of the toilet seat, nuts of resilient material which have a conical nose portion adapted to enter partially into the bolt holes of the toilet bowl.

DETAILED DESCRIPTION OF THE PREFERRED EMBODIMENTS

Figure 1:
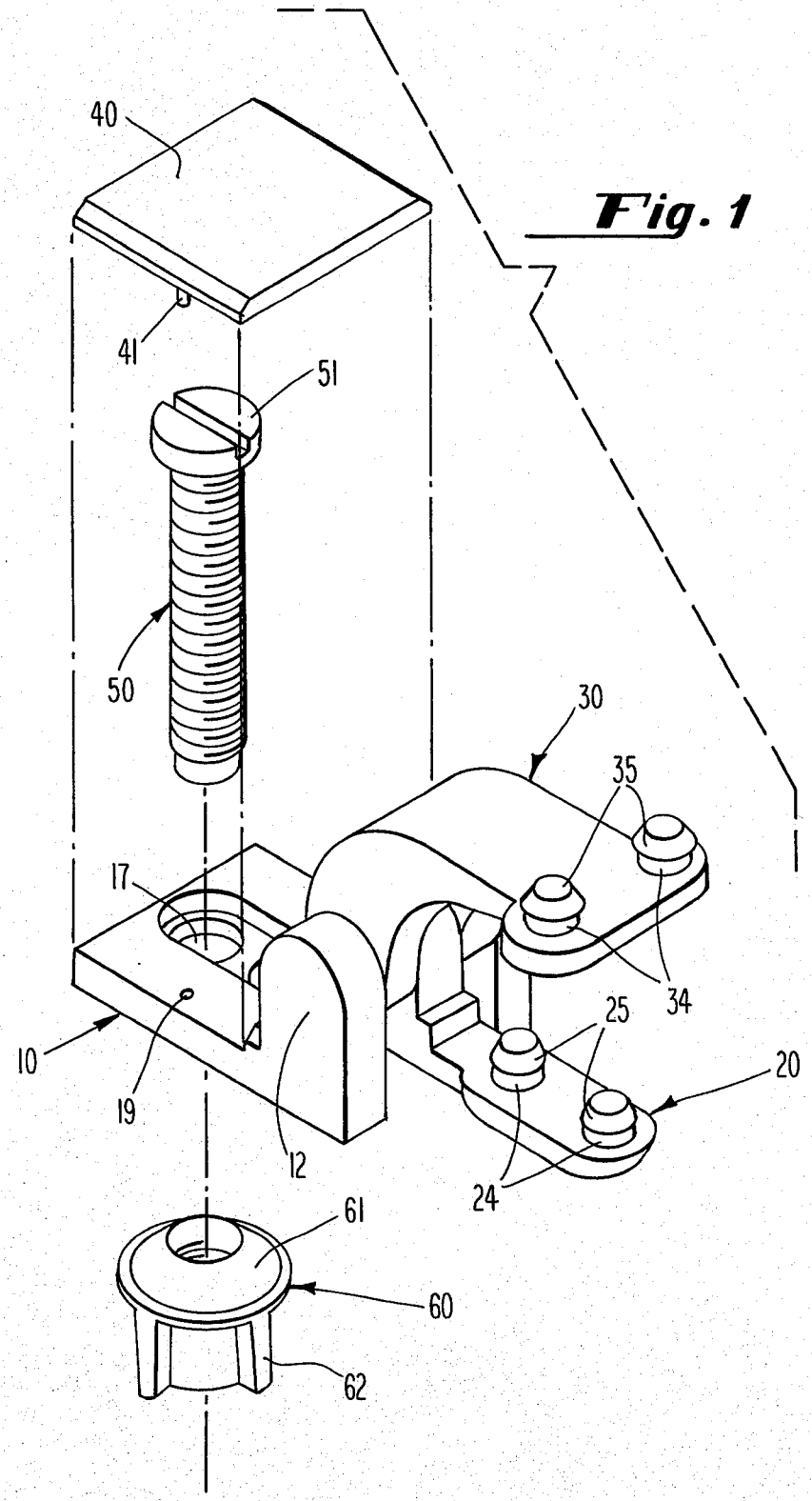
FIG. 1 is an exploded view of the improved hinge according to the present invention.
Figure 2:
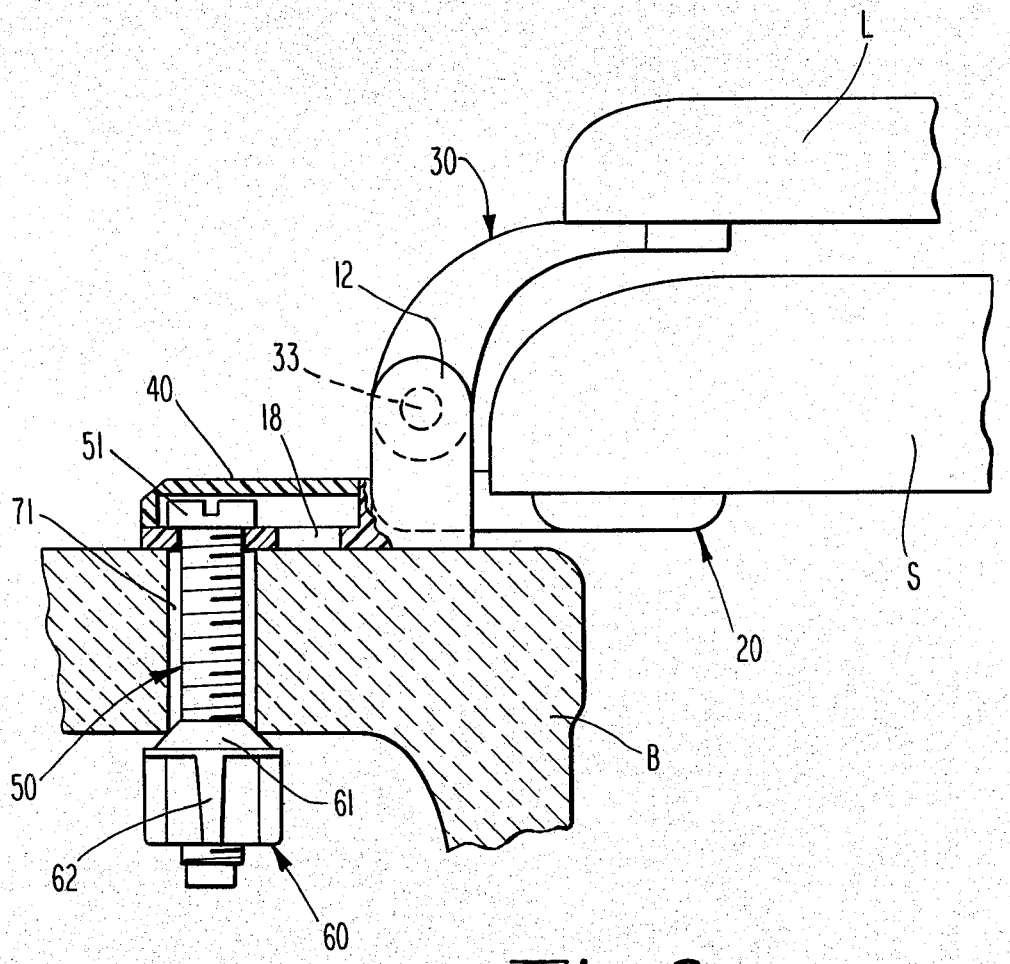
FIG. 2 is a side elevational view, partly in section, showing the improved hinge installed in the toilet bowl.

Referring now to FIGS. 1 and 2, there is shown a single toilet seat hinge comprising a rearwardly extending base portion 10 adapted to be attached to the toilet bowl B, a forwardly extending lower arm or leaf 20 adapted to be attached to the underside of the toilet seat ring S at the rearward end thereof, and a forwardly extending upper arm or leaf 30 adapted to be attached to the underside of the lid L at the rearward end thereof.

The hinge shown in FIG. 1 is an improved hinge which is described and claimed in a co-pending application Ser. No. 385,545, filed June 7, 1982, now U.S. Pat. No. 4,398,307, by Milton Ginsburg et al, assigned to Ginsey Industries, Inc., the assignee of the present application.

As seen in FIG. 1, extending upwardly from seat leaf 20 at the forward portion thereof are a pair of studs 24 each of which has an enlarged head 25 of frusto-conical shape. Similarly, projecting upwardly from the upper surface of the forwardly extending portion of seat leaf 30 are a pair of studs 34 each of which has an enlarged head 35 of frusto-conical shape. As described in greater detail in co-pending patent application, Ser. No. 385,545, the studs 24 are snapped into locked position through expandible holes which are provided in the seat S. Similarly, the studs 34 are snapped into locked position into a pair of expandible holes provided in the lid L.

The rearwardly extending portion 10 of the hinge is provided with a pair of bolt holes 17 and 18, one of which is rearward of the other. In FIGS. 1 and 2 of the present application, the bolt is shown as being passed through bolt hole 17 which is rearward of bolt hole 18. In some toilet installations, the position of the water tank, relative to the location of the hinge pivot points of the toilet seat ring and lid, is such that when the lid and seat ring are raised, the ring is unable to pass through the vertical plane to an over-the-center position and, as a result, the ring does not remain in the raised position but instead falls back down. This problem may be particularly troublesome in the case of a cushion toilet seat. In such case, the rearward bolt hole 17 is used. This moves forwardly the location of the hinge or pivot axis of the toilet seat ring and lid relative to the water tank, thereby enabling the raised seat ring to pass through the vertical plane to an over-the-center position, thereby enabling the ring and lid to remain in the raised position.

For appearance, and to facilitate cleaning, the bolt holes 17 and 18 are capped by a cap 40 which may preferably be press fitted into position, as by the studs 41 being inserted into the holes 19.

As seen best in FIG. 2, when the threaded bolt 50 is inserted through the bolt hole 17 and down through the bolt hole 71 which is provided in the porcelain bowl B, a sufficient portion of the threaded shank of bolt 50 projects from the undersurface of the bowl B to allow a nut 60 to be threaded onto bolt 50. The improvement provided by the present invention resides in the design and properties of the nut 60.

In accordance with the present invention, nut 60 is preferably made of resilient material, preferably plastic and its nose end 61 is given a conical configuration so that when nut 60 is finger tightened on threaded bolt 50, the forward small-diameter portion of the conical nose 61 enters into the bolt hole 71 of the porcelain bowl B until the sloping sidewall of the conical nose 61 engages the lower edge 72 of the bolt hole 71. Further finger tightening of nut 60 causes the edge 72 to compress the resilient plastic material of conical nose 61 and, as a result of this frictional engagement, nut 60 firmly holds bolt 50 against movement within the bolt hole 71. In addition, the frictional engagement between the conical nose 61 and the lower edge 72 of the bowl bolt hole 71 tends to prevent loosening of the nut 60 during use.

In the manner just described, the improved nut 60 holds the toilet seat firmly in place despite the fact that bolt hole 71 in porcelain bowl B is substantially larger in diameter than bolt 50.

What is claimed is:

1. A hinge assembly for securing a toilet seat to a toilet bowl having bolt holes therethrough, said hinge assembly comprising:

a. a rearwardly extending base portion for attachment to the toilet bowl;

b. a forwardly extending lid leaf portion pivotally secured to said base portion;

c. a forwardly extending seat leaf portion pivotally secured to said base portion;

d. said base portion having at least one bolt hole therethrough;

e. an elongated bolt having a threaded end portion, said bolt adapted for insertion through the bolt holes in said base portion and bowl, and projecting from the bolt hole in said bowl the diameter of said bolt being substantially smaller than the diameter of said bolt hole, leaving an annular space in said hole surrounding said bolt;

f. a threaded nut for threading onto the threaded end of said bolt;

g. said nut having a conical nose of resilient material;

h. said conical nose having a forward portion which is smaller in diameter than the diameter of said bolt hole of said bowl, the rearward portion of said conical nose being larger in diameter than the diameter of said bowl bolt hole;

i. wherein when said nut is rotated in a tightening direction, said conical nose of said nut enters said annular space in said hole surrounding said bolt, and j. wherein further rotation of said nut in the tightening direction causes said threaded end of said bolt to occupy a central position in said bolt hole, the lower larger-diameter portion of said nose being in resistive engagement with the lower edge of said bolt hole and tending to inhibit free rotation of said nut in a loosening direction.

2. A hinge assembly according to claim 1 wherein said nut is provided with vertically extending ribs at spaced intervals to assist in finger tightening said nut.

3. A hinge assembly according to claim 2 wherein said nut is made of resilient plastic.

* * * * *